US005161857A

United States Patent [19]

Mayercheck et al.

[11] Patent Number: 5,161,857

[45] Date of Patent: Nov. 10, 1992

[54] TELEOPERATED CONTROL SYSTEM FOR UNDERGROUND ROOM AND PILLAR MINING

[75] Inventors: William D. Mayercheck, New Stanton; August J. Kwitowski, Clairton; Albert L. Brautigam; Brian K. Mueller, both of Pittsburgh, all of Pa.

[73] Assignee: The United States of America, as represented by the Secretary of the Interior, Washington, D.C.

[21] Appl. No.: 692,889

[22] Filed: Apr. 29, 1991

[51] Int. Cl.[5] ..... E21C 35/24

[52] U.S. Cl. ..... 299/30; 299/1.4; 364/420; 364/922.6; 364/DIG. 2

[58] Field of Search ..... 299/1.05, 1.4, 1.8, 299/1.9, 30; 175/40; 364/420

[56] References Cited

U.S. PATENT DOCUMENTS 4,172,615 10/1979 Hakes ..... 299/30

4,323,280 4/1982 Lansberry et al. ..... 299/1

OTHER PUBLICATIONS

Kwitowski et al "Controlling a Thin-Seam Miner 500 Feet From the Face," Eighth WVV Mining Electrotechnology Conference, Jul. 1986 pp. 80-85.

Kwitowski et al "Ergonomically Designed Operator Workstation for a Computer-Aided Remotely Controlled Mining System," International Conference on Ergonomics, Occupational Safety and Health and the Environment, Oct. 1988 pp. 362-373.

*Mining Congress Journal* Sep. 1976 "Remote-Control Mining and Continuous Roof Bolting", Miller et al. pp. 22-28.

*Primary Examiner*—David J. Bagnell

*Attorney, Agent, or Firm*—E. Philip Koltos

[57] ABSTRACT

A teleoperated mining system is provided for remotely controlling the various machines involved with thin seam mining. A thin seam continuous miner located at a mining face includes a camera mounted thereon and a slave computer for controlling the miner and the camera. A plurality of sensors for relaying information about the miner and the face to the slave computer. A slave computer controlled ventilation sub-system which removes combustible material from the mining face. A haulage sub-system removes material mined by the continuous miner from the mining face to a collection site and is also controlled by the slave computer. A base station, which controls the supply of power and water to the continuous miner, haulage system, and ventilation systems, includes cable/hose handling module for winding or unwinding cables/hoses connected to the miner, an operator control module, and a hydraulic power and air compressor module for supplying air to the miner. An operator controlled host computer housed in the operator control module is connected to the slave computer via a two wire communications line.

11 Claims, 4 Drawing Sheets

TELEOPERATED CONTROL SYSTEM FOR UNDERGROUND ROOM AND PILLAR MINING

FIELD OF THE INVENTION

This invention relates generally to coal mining and more specifically, to a remotely controlled continuous mining machine which is capable of cutting coal lying in thick or thin seams by utilizing a communication and control system which relays information to a remotely located operator.

BACKGROUND OF THE INVENTION

In underground room and pillar coal mines, the array or pattern of mined areas and remaining unmined coal pillars might, when viewed with X-ray vision from an overhead airplane or helicopter, resemble the squares of a multi-colored chess board. In a typical mine in the United States, about half of the available coal seam is extracted or mined while the other half is left in the remaining coal pillars in order to support the mine roof, i.e., to prevent dangerous roof collapses, and to prevent overhead surface subsidence. This method of mining in the United States accounts for about two-thirds of all underground coal production.

In a conventional mining operation, a miner operator and an assistant are situated on or near a continuous mining machine as coal is being mined and hauled away from the face area. Also, two or more operators are required to haul or transport the mined product away from the face area to an outbye dump station, usually situated hundreds of feet from the mining face. This method of mining features many hazards to the life of coal miners who work underground. These hazards include the following: unsuspected roof falls that can maim or kill miners; methane/coal dust explosions that may be touched off with just one small spark; long-term health effects from breathing fine-sized coal dust; inner ear damage from loud noise pollution in a confined work area; and other general hazards related to heavy mining equipment moving about in confined roadways in an underground mine.

One method of avoiding the above-mentioned problems is to relocate the miners hundreds or perhaps thousands of feet distant from the active and hazardous area being mined. This relocation requires adequate technology to remotely control the face area machinery and the remote reception of the same or similar sensory feedback that the miners currently have while located on or near to heavy mining extraction and coal haulage equipment in the face area. In prior art remote mining machines, the ability to follow a relatively thin seam of coal with any degree of precision is a problem. This lack of precision results in unwanted rock, slate, and shale being cut along with the coal and from which the coal must be later separated. This additional separation adds to the cost of mining coal. Examples of such machines include those disclosed in U.S. Pat. Nos. 4,323,280 (Lansberry et al.); 3,776,592 (Ewing); 4,008,921 (Czauderna et al.); and 4,753,484 (Stolarczyk et al.).

The Lansberry et al. patent discloses a remote mining system used in highwall mines. This mining system incorporates a continuous mining machine, a remote control station, electrical cables for connecting the mining machine with the remote control station, TV cameras, and laser and sonar sensors for keeping the mining machine on a straight line. One disadvantage of this system is that the system will not function in a thin seam mining operation. The reason for this is that because the control station in this system is the size of a house trailer, the system is unable to enter a thin seam mine. Further, although the mining system provides the operator a visual display of the mining face as well as separate information from the laser and sonar sensors, this information is displayed in several different formats, i.e., the video information is displayed on a monitor, the laser information is displayed by a set of lights which indicate direction from a central line, and the sonar information is displayed as an analog read-out. As a result, an operator will have to monitor three different displays with three different formats at the same time.

The Ewing patent discloses a remote mining machine where an operator is located at a launching platform. The operator controls the machine by visual feedback from a set of lights located on the miner. This visual feedback requires the operator to be located near the mining face.

The Czauderna et al. patent discloses an automatic cutter which incorporates isotope test probes to determine the location of the coal rock interface. This depth information is input into a special purpose computer which controls the automatic cutter. This device relies on the coal face being relatively straight and would require direct human intervention to realign the cutter in case of a variation, such as a turn, in the coal face. This device is also restricted by the fact that all the control systems are operated by computer software. Thus, if the system encounters a highly discontinuous or irregular surface, the system will leave behind unmined coal and may also remove some rock. The removal of rock prevents a number of significant safety hazards. These safety hazards range from the possibility of a roof cave-in to the potential for an explosion due to sparks, produced by the cutting of the rock, causing the igniting of ambient coal dust.

The Stolarczyk et al. patent discloses a remotely controlled longwall shearer. The mechanical functions of the shearer are controlled by an operator using a medium frequency transmitter operating in the range from 300–1000 kHz and sending the signal through an alternating current (AC) power cable. A receiver, located on the shearer, receives the transmitted signal and decouples it from the AC power signal. The system provides the operator information on the coal layer thickness by means of a sensor located at the face area of the mine. No visual representation of the coal face is provided.

The following articles provide additional background material on remote mining operations: "Controlling a Thin-Seam Miner 500 feet from the Face", 8th WVU International Mining Electrotechnology Conference, Morgantown W.V., Jul. 30 - Aug. 1, 1986, pp. 80–85; and "Ergonomically-Designed Operator Workstations for a Computer-Aided, Remotely Controlled Mining System", Proceedings International Conference on Ergonomics, Occupational Safety and Health and the Environment, Beijing, China, Oct. 24–28, 1988, pp. 362–373.

SUMMARY OF THE INVENTION

According to the invention, a teleoperated mining system is provided which overcomes the problems discussed above and enables mining of coal in a safe manner. The teleoperated mining system of the invention comprises a thin seam continuous miner located at a mining face and including a slave computer and at least one camera mounted thereon. Both the miner and the camera are controlled by the slave computer. A plurality of sensors relay information about the miner and the face to the slave computer. A ventilation sub-system, which is also controlled by the slave computer, removes combustible material from the mining face. A haulage sub-system, which is controlled by a slave computer, removes material mined by the continuous miner from the mining face to a collection site. A base station is provided to control and supply power and water to the continuous miner, haulage system, and ventilation subsystem. The base station comprises a cable/hose handling module for winding or unwinding cables/hoses connected to the continuous miner, an operator control module providing an ergonomically designed control facility, and a hydraulic power and air compressor module for supplying air to the continuous miner and hydraulic power to the base station modules. A host computer is housed in the operator control module and is connected to the slave computer via a two wire communications line. The host computer receives commands from an operator located at the base station.

By locating the base station far from the mining face, there is significantly less risk of the operator being affected by the hazardous conditions of the mining face. In particular, the miner will not be breathing fine-sized coal dust or have problems with inner ear damage. Further, the possibility of an operator being trapped in a roof fall or injured by an explosion is significantly reduced.

By expanding the control of the slave computer to the control of roof bolting equipment, the need for humans to be present during the roof control process is eliminated. The invention is also applicable to other remotely controllable mining equipment.

Other features and advantages of the invention will be set forth in, or apparent from, the following detailed description of the preferred embodiments of the invention.

DESCRIPTION OF THE PREFERRED EMBODIMENTS

Figure 1:
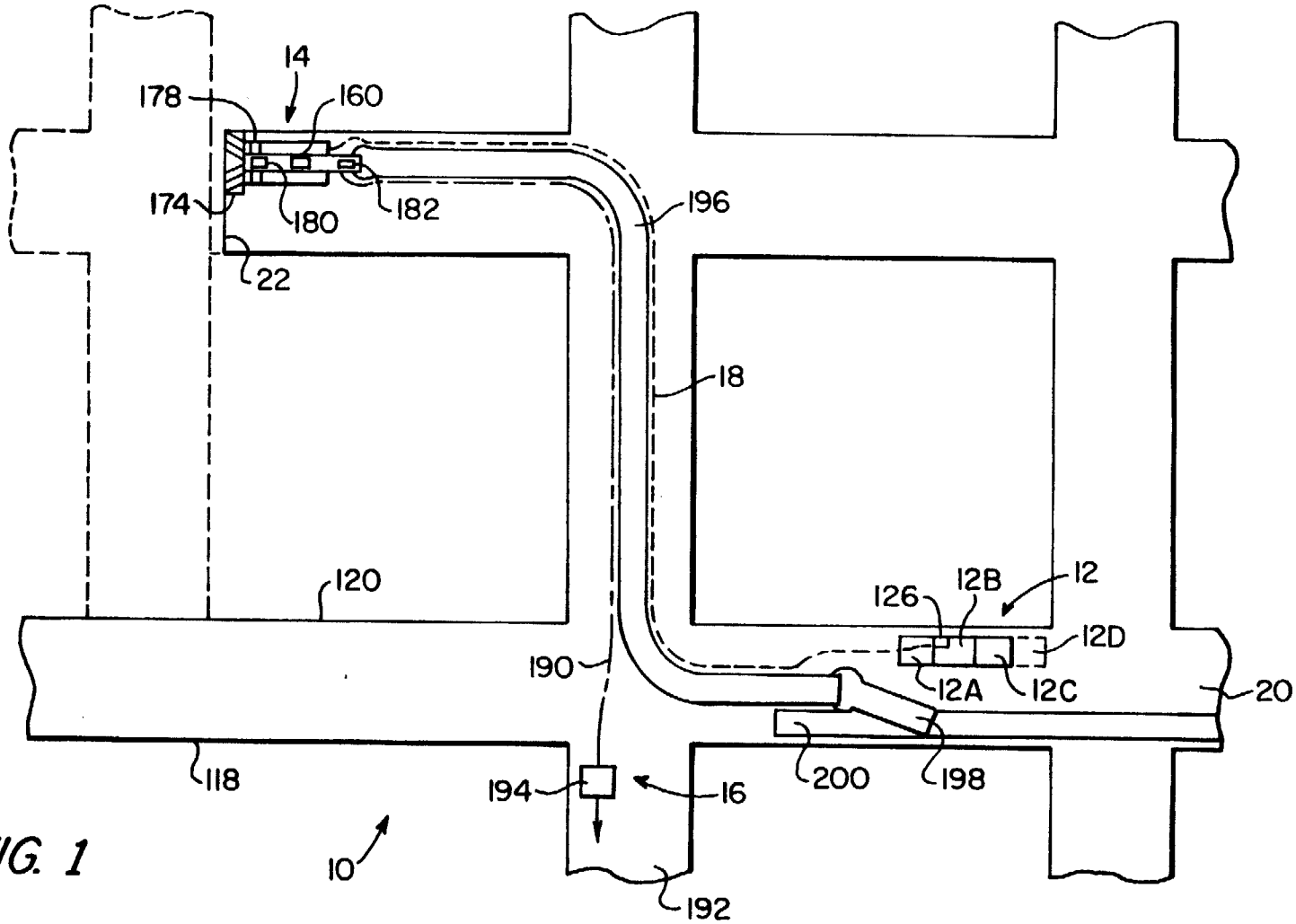
FIG. 1 is a plan view of a teleoperated mining device constructed in accordance with a preferred embodiment of the invention.

Referring to FIG. 1, a remote mining system constructed in accordance with a preferred embodiment of the invention is shown schematically in a thin seam mine. The remote mining system, which is denoted 10, is composed of the following elements: a base station (denoted 12), a communications and control system, a teleoperated thin seam continuous miner (denoted 14) and sensors, a coal haulage system (denoted 196), and a ventilation system (denoted 16).

The Base Station

In FIG. 1, base station 12 is located in a belt or chain conveyance entry 20 in the mine although the base station 12 can be located farther from a mining face 22 or can even be several miles away. In a preferred embodiment, the base station 12 would be designed to have a height as low as 32". This 32" height provides the ability to place the base station 12 in a low or thin seam mine. In an alternative embodiment, the base station would be 84" or more in height. The 84" base station 12 would provide additional space for a human operator in high seam mining operations while still providing the ability to locate the base station 12 inside of the mine.

Figure 2:
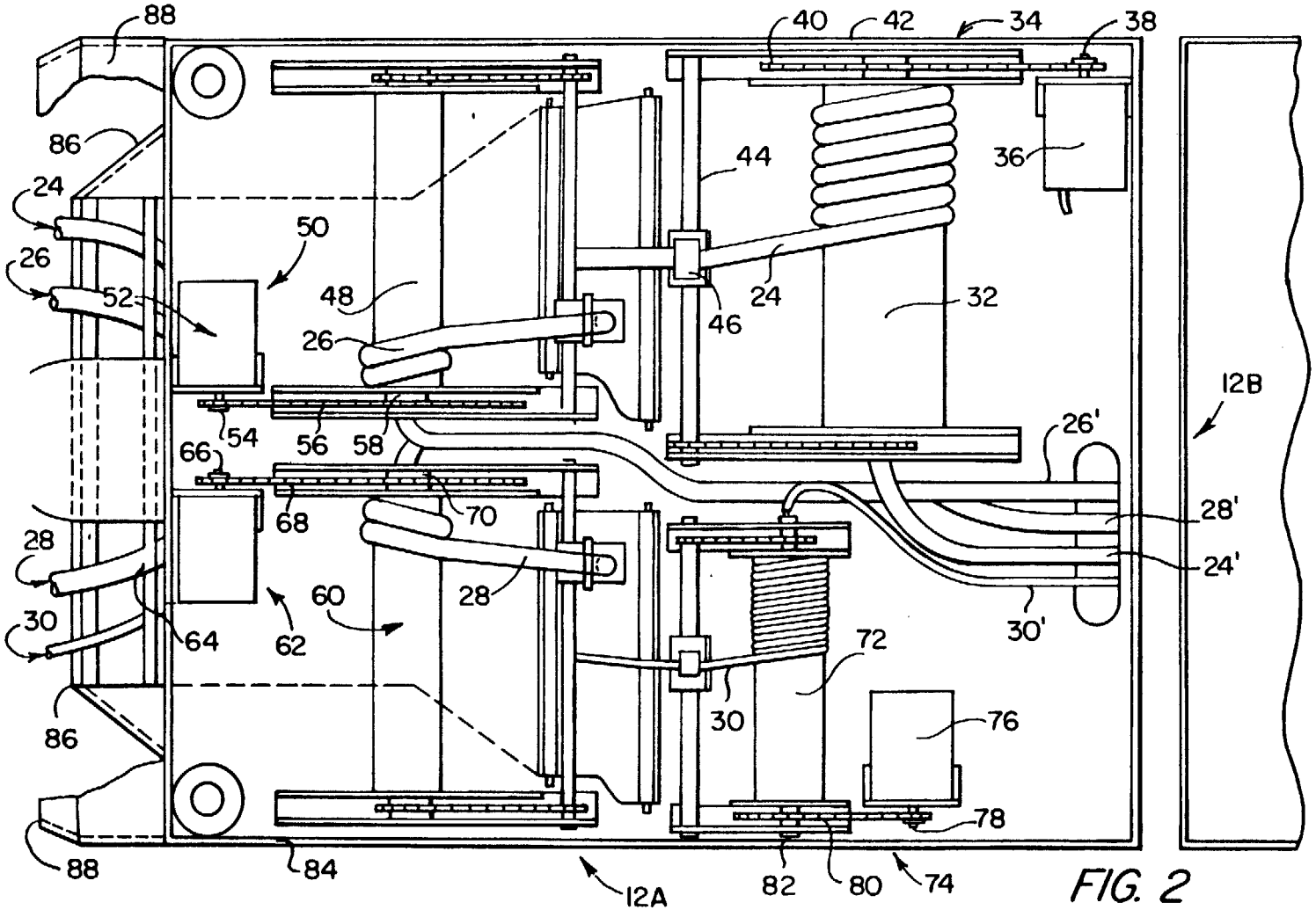
FIG. 2 is a plan view of the cable/hose handling module of FIG. 1.
Figure 3:
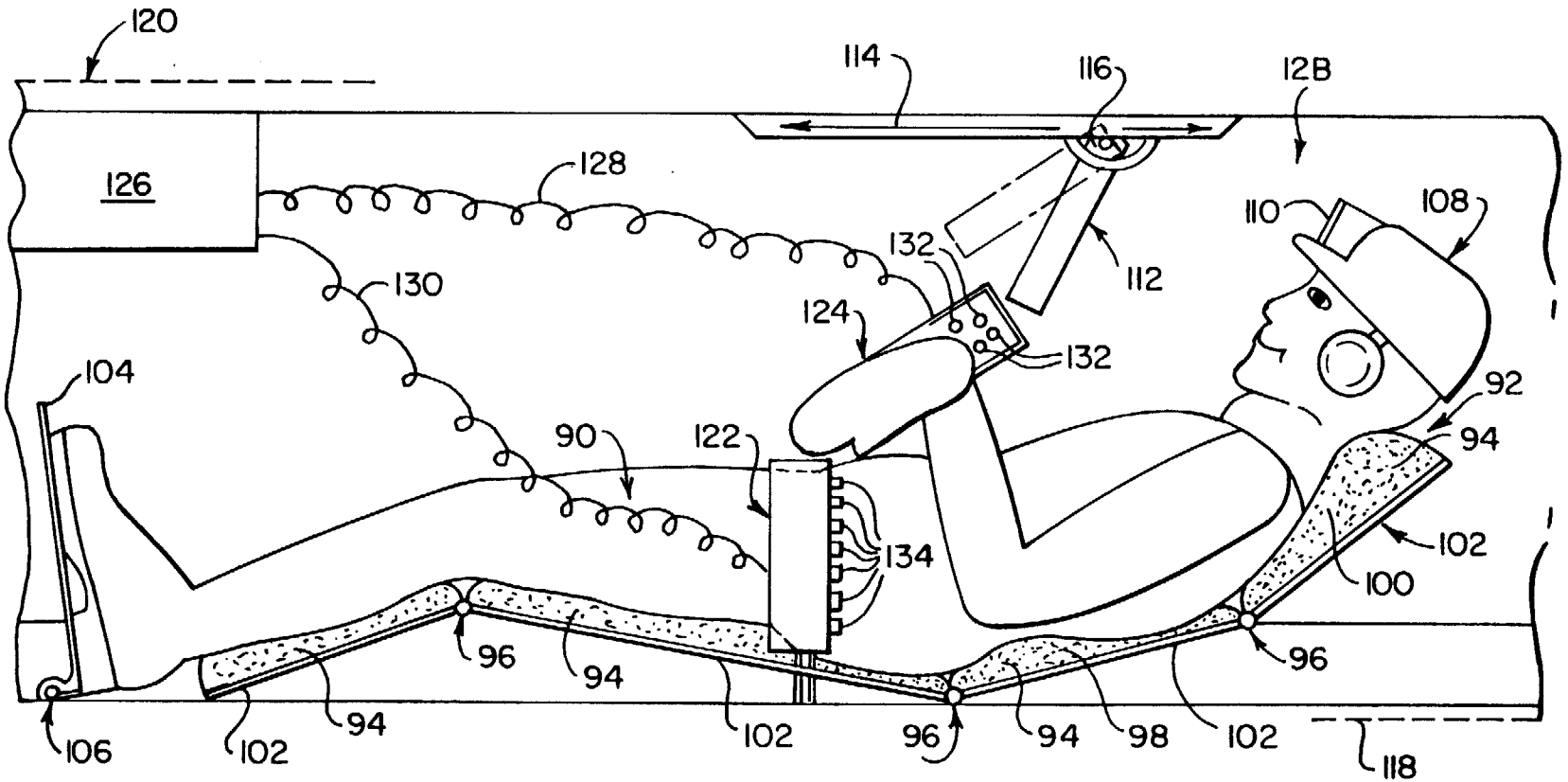
FIG. 3 is a front elevational view of the human operator control module of FIG. 1, with a side wall removed.

Base station 12 is composed of four modules: a cable/hose handling module 12A, an operator control module 12B, a hydraulic power and air compressor module 12C, and an optional power supply module 12D. The modules 12B, 12C, and 12D may be arranged in any order desired, e.g., while the first module should be the cable/hose handling module 12A, the other modules can be arranged in any desired order. FIGS. 2 and 3 illustrate modules 12A and 12B in greater detail.

Referring to FIG. 2, the cable/hose handling module 12A is illustrated. Module 12A is portable and moves periodically as the mining face 22 is advanced in the mining section. The cable/hose handling module 12A houses a miner cable 24, a control/communications cable 26, a water hose 28, and a compressed air hose 30. Miner cable 24 is wrapped around a reel 32 which is actuated by a miner drive assembly 34. Miner drive assembly 34 comprises a conventional motor 36, a pulley 38 attached to motor 36, and a belt or chain 40, which engages a spindle 42. Miner drive assembly 34 imparts motion to reel 32 by providing a clockwise or counter-clockwise rotation which in turn winds or unwinds miner cable 24 so as to provide additional cable when the mining face 22 moves farther down the mine. A support rod 44 extends the entire length of reel 32. Mounted on support rod 44 is a movable guide 46 which affixes miner cable 24 to the support rod 44. Guide 46 ensures that the miner cable 24 will be evenly wrapped on reel 32. It should be noted that miner cable 24 is mounted onto reel 32 in such a way as to allow a continuous connection between cable 24 and an input miner cable 24'.

The control/communications cable 26 is wrapped around a reel 48. Reel 48 is actuated by a communications/control drive assembly 50 which functions similarly to miner drive assembly 34. The communications/-control drive assembly is composed of a motor 52, a pulley 54, a belt or chain 56, and a spindle 58. Elements 52, 54, 56, and 58 correspond to elements 36, 38, 40, and 42 described above. It is noted that the control/communications cable 26 is mounted on reel 48 in such a way as to allow a continuous connection between cable 26 and an input control/communications cable 26'. In a preferred embodiment, the control/communications cable will be a two wire conductor which will support information exchange in the medium to high frequency range.

The water hose 28 is wrapped around a reel 60. Reel 60 is actuated by a water hose drive assembly 62 which functions similarly to miner drive assembly 34. The water hose drive assembly 62 is composed of a motor 64, a pulley 66, a belt or chain 68, and a spindle 70. Elements 64, 66, 68, and 70 correspond to elements 36, 38, 40, and 42 described above. Water hose 28 is mounted on reel 60 in such a way as to allow a continuous connection between hose 28 and a water supply hose 28'.

The compressed air hose 30 is wrapped around a reel 72. Reel 72 is actuated by a compressed air hose drive assembly 74 which functions similarly to miner drive assembly 34. The compressed air hose drive assembly 74 is composed of a motor 76, a pulley 78, a belt or chain 80, and a spindle 82. Elements 76, 78, 80, and 82 correspond to elements 36, 38, 40, and 42 described above. Air hose 30 is mounted on reel 72 in such a way as to allow a continuous connection between hose 30 and a further air supply hose 30'.

A housing 84 encapsulates the cable/hose handling module 12A. Mounted at the front base of the housing 84 is a debris deflector 86. Debris deflector 86 extends virtually the entire width of the module 12A. Mounted to the front top of the housing 84 and extending the entire length of module 12A is a debris deflector canopy 88 which prevents debris from falling from the roof of the mine into module 12A.

Referring now to FIG. 3, the operator control module 12B is shown. Module 12B is portable and moves periodically as the mining face 22 is advanced in the mining section. Inside this module 12B, the operator comfortably and safely controls the operation of the continuous miner 14 and related equipment located hundreds or even thousands of feet away. The operator has control over the continuous miner 14 and the cable/hose handling module 12A for controlling miner, control/communication, water, and air cables numbered 24, 26, 28 and 30 respectively. As mentioned above, these cables/hoses are housed in the cable/hose handling module 12A.

The operator control module 12B is designed to hold a human operator 90 who is seated in an adjustable seat 92. The seat 92 is composed of padded sections 94 which are attached by pivots 96. The pivots are positioned to correspond to the natural pivot points of a human body. A lumbar support bladder 98 is provided in the padded section 94 which supports the human operator's 90 back. The support bladder 98 helps to provide additional support to the user and helps to reduce fatigue due to being in a stationary position for an extended period of time. The final padded section 94 has a profile for a headrest bladder 100. Each padded section 94 has a structural support member 102 attached to the bottom to provide rigidity to the seat 92. An adjustable foot rest 104 will be attached to the floor of module 12B by a pivot 106 or similar attachment known in the art. Pivot point 106 allows the operator 90 to flex his/her legs to avoid fatigue caused sitting in one position for an extended period of time.

The operator may or may not wear a standard miner's hardhat 108 with a light or lamp 110 attached to the front of hardhat 108.

One or more video monitor(s) 112 is/are mounted to the inside of the roof of module 12B. The video monitor 112 is attached to a guide track 114 by a pivotal mount 116. The guide track 114 allows the video monitor 112 to be moved back and forth so that the monitor 112 may be adjusted to suit the particular requirements of operator 90. The pivotal mount 116 allows for the video monitor 112 to be rotated to suit the particular requirements of the operator 90. Video monitor 112 displays information gathered by cameras 180 and 182 and sensors 174 located at the mining face 22. Video monitor 112 will display digital signals as well as analog output devices including idiot lights, bargraph displays, and analog meters. The video monitor 112 has the advantage over prior art devices of being able to display related information in an organized grouping so as to reduce the distraction of having several different meters to focus upon. As mentioned above, in one preferred embodiment, the module 12B is designed to have a specific height of 32" in that this height provides sufficient space between the mine floor 118 and the mine roof 120.

A primary control unit 124 is adapted to fit in the operator's hands. This primary control unit 124 has switches 132 which provide access to the most utilized operator controls for the continuous miner 14. An example of the functions that would be controlled by the primary control unit 124 are tram direction and auger position. The unit or module 124 for primary control is connected to the host computer system 126, described below, by an extensible multiconductor cable 128.

A module 122 for secondary control is provided within easy reach of the operator. This secondary control module 122 includes switches 134 that activate secondary functions of the continuous miner 14 and various sensors and cameras described below. An example of several functions that will be controlled by the module for secondary control are continuous miner: pump motor on/off, conveyor direction, auger motor on/off, water spray on/off, plow position; haulage equipment: pump on/off, tram direction, conveyor on/-off; video camera: iris open/close, zoom in/out, focus in/out; and automated cutting cycle functions. The secondary control module 122 is attached to the host computer system 126 by a multi-conductor cable 130 which is similar to cable 128.

The hydraulic control module 12C (not shown) encases a hydraulic power supply and an air compressor unit, both of which are commercially available. The hydraulic power supply (not shown) provides the pressurized hydraulic fluid to the modules 12A and 12B and is conventional in nature. The air compressor (not shown) provides air supply to the compressed air supply hose 30'. As noted above, in a preferred embodiment, the height of module 12C is less than 32". This height restriction is required so that module 12C may be placed inside of the coal mine.

The power supply module 12D (not shown) is an optional module and is conventional in nature. It may be attached to the other modules 12A, 12B or 12C to provide power, if there is no other power supply, or may be remotely located from the base station 12. The power supply module 12D is commercially available in standard sizes and would provide adequate power to satisfy the system requirements. Minor height modifications may be required in conventional units in order to satisfy the 32" requirement for use in a thin seam mine.

The Communications and Control System

Figure 4:
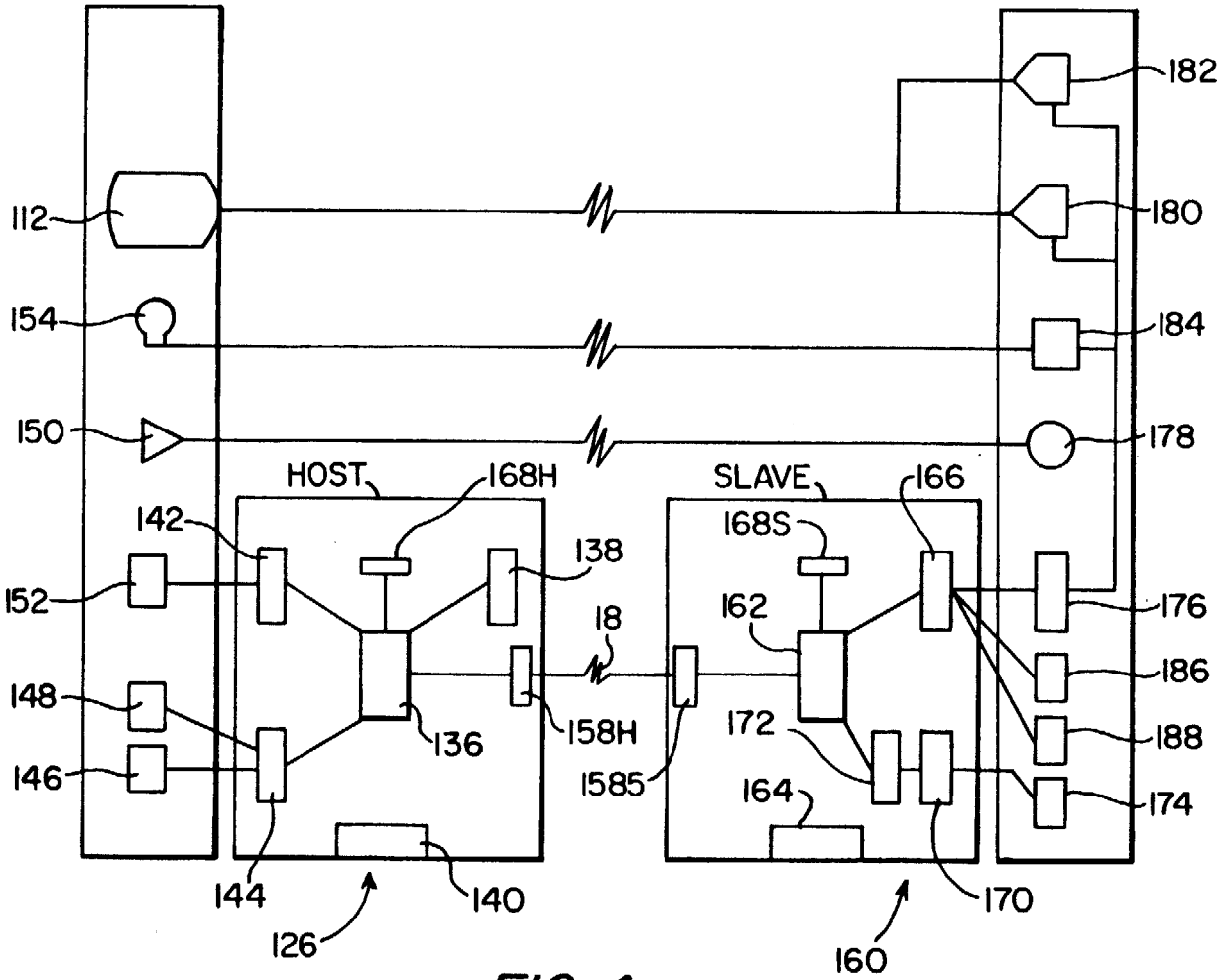
FIG. 4 is a block diagram of the communications/-control system of the teleoperated mining device of FIG. 1.

Turning now to the communication and control system of the teleoperated miner, FIG. 4 illustrates the major components of the communication and control system. In preferred embodiments, one or the other two alternative electronic control systems, an Intel BITBUS system and a Texas Instruments (TI) 545 Programmable Logic Controller system is used. For the sake of simplicity, only the Intel option will be discussed in relation to FIG. 4.

The host computer 126 is composed of an Intel iRCB 44/10A BITBUS digital I/O remote controller board with a piggy-backed Computer Dynamics CDX-P48 SBX parallel I/O board, an Intel iPCX 344A which communicates with a collocated IBM personal computer (PC) or clone. The PC is used to control the display on the monitor 112. The CDX-P48 board provides 48 parallel input lines which are used to read the operator's inputs. The BITBUS is based on Intel's 8044 CPU, item 136, chip which incorporates an 8051 microcontroller and a high speed synchronous data link controller (SDLC). A clock 138 inputs signals to the CPU 136 and the above mentioned cards to provide timing.

The CPU is powered by power supply 140. In a preferred embodiment, the power supply 140 is an uninterruptible power supply such as the TII Electronics Inc. EHVQ-170E-8 or any other suitable power supply.

An optional digital to analog converter 142 is connected to CPU 136 for providing analog signals to the analog displays 152.

An input/output (I/O) port 144 is attached to the CPU 136 to provide for information exchange between the CPU 136 and the operator. In a preferred embodiment, the I/O port would be controlled by the above mentioned CDX-P48 board.

Inputs from the primary and secondary control units 124 and 122 are entered to CPU 136 via interface element 146 which is connected to the I/O port 144. The displays on video monitor 112 are received via tethered cables connected to a set of video cameras 180 and 182. In a preferred embodiment, a squash button 154 would be provided to permit the operator to stop the continuous miner 14 in emergencies via a master relay 184. A diagnostic port 168H is attached to the CPU 136 to provide for running of diagnostic programs.

The host computer 126 would communicate with a slave computer 160 via a communications/control line 18. In a preferred embodiment, communications/control line 18 will be a two conductor, hard wired tether cable supporting information exchange in the medium to high frequency range. In order to avoid signal degradation along communication/control line 18, a pair of modems or ranged communication devices 158H and 158S will be located at the host and slave sites respectively and are also connected to their respective CPU's 136 and 162.

The slave computer 160 is composed of three slave network nodes. Each node consists of an Intel iRCB 44/20A analog I/O controller. The three iRCB 44/20A boards provide a total of 48 channels of analog input for reading data from machine mounted sensors on the continuous miner and haulage system. One of the iRCB 44/20A has a piggy-backed Computer Dynamics CDX-P48 SBX parallel I/O board. The CDX-P48 board provides 48 parallel output lines which are used to control the operating functions of the continuous miner 14, video cameras 180 and 182, haulage system, and/or ventilation system 16. The slave computer 160 has components for the CPU 162, a modem or ranged communication device 158S, a power supply 164, an I/O port 166 controlled by the CDX-P48 board, and an optional diagnostics port 168S which are connected to the CPU 162 and function in a similar fashion to corresponding elements 136, 158H, 144, and 168H. In addition, the slave computer 160 has a signal conditioner 170 for receiving inputs from the various machine sensors 174, described below, located at the mine face 22. The signal from the signal conditioner 170 is received by an analog to digital converter 172 which in turn sends the signals to the CPU 162. Input to the I/O port 166 is provided by input limit switches and decoders 188 mounted on continuous miner 14. Outputs from the I/O port 166 is received by a relay package 176 which controls the signals to the master relay 184, machine actuators 186, and the set of video cameras 180 and 182.

The software implemented on both the host and slave computers 126 and 160 was developed using a high level programming language for the Intel 8044 microprocessor called PL/M 51. Additionally, an operating system called iDCX/51 was used to provide the capability for real time multi-tasking process control.

The communications link provided by communications/control line 18 is critical; data at a rate of 375,000 bits/second must pass intact through a single twisted pair wire contained in a single line 18. The need for error-free transmission of data between the computers which may be at most 1,000 feet apart, is complicated by the extreme amount of electrical noise present in coal mines. If a faulty signal would reach the slave computer 162, the continuous miner 14 would behave in unpredictable ways and would be a dangerous safety hazard. This problem of signal integrity is solved by employing short haul modems or other ranged communication devices 158H and 158S, transient suppression devices and special data encryption and decoding software.

In the alternative control system referred to above, a TI 545 Programmable Logic Controller (PLC) system is used which includes a host computer comprising a TI 505-6660 power supply, a TI 505-6508 545PLC attached to a collocated IBM PC or clone, and a TI 505-6508 8-slot I/O base. The TI 545 PLC is designed around the Motorola 68020 microprocessor chip. Up to a total of 1024 I/O channels are supported by the TI 545 PLC. Two TI 505-4132 32-input module boards are mounted in the I/O base. These two boards provide a total of 64 digital input lines which are used to read the operator's 90 commands from the primary and secondary control units 124 and 122. An RS232C communications port is connected to the communications port of an environmentally hardened IBM PC or compatible which is also located in the operator station 12B. The PC is used to control the data presentation on monitor 112.

The remote PLC base is mounted on a continuous miner 14 and comprises a stand-alone enclosure 160 including a TI 505-6660 power supply, a TI 505-6851 remote base controller, and a TI 505-6508 8-slot I/O base. Two TI 505-4532 32-output module boards are mounted in the remote I/O base. These two boards provide a total of 64 lines which are used to control the machine operation, the cameras, the coal haulage system, and/or the ventilation system. Six Control Technology Inc., model 250, 8-channel isolated analog input module boards are also mounted in the remote I/O base. These boards provide 48 channels of analog input for reading data from the sensors and cameras mounted on the continuous miner 14. This system has the advantage of being able to be located up to 3,300 feet from the mining face 22.

It should be noted that both of these options provide for controlling of remote equipment from a safe distance. While the specific hardware may vary, the intended purpose and method of carrying out the data transfer are similar.

The advantages of using either system as described above include: 1) control and sensory data is processed and sent over only a two wires; 2) a wide range of sensory information is collected from the face area 22 and displayed to the human operator through a variety of user-friendly output devices; 3) a voice synthesizer provides selective information to the human operator; 4) diagnostic functions are incorporated which simplifies maintenance and repair; and 5) operational and hardware changes are easily implemented.

The Continuous Miner, Cameras, and Sensors

Referring again to FIG. 1, the continuous miner 14 is shown in a thin seam coal mine. The continuous miner 14 is a commercially available unit and in a preferred embodiment, a Jeffrey model 101/102 is utilized. The model 101/102 has the following advantages: 1) the flat upper surface allows television cameras 180 and 182 to be placed in a variety of positions with relatively unobstructed view; 2) additional space is available for add-on equipment; and 3) precise control of the extraction process is feasible because the cutting auger is sumped into the face 22 by hydraulic rams while the main body of the miner remains stationary. Power is supplied to the miner 14 by the miner cable 24. Control of the functions of the miner 14 are maintained by the slave computer 160 which receives commands from the host computer 126 via the communication/control line 18. The slave computer 160 controls miner 14 and supercedes the normal tethered mode of operation that is available on the Jeffrey model 101/102s.

The cameras 180 and 182 are commercial available units that are housed in specially designed, explosion-proof enclosures. In a preferred embodiment, solid state Sony DXC-102 cameras equipped with 11 to 110 mm zoom lenses would be mounted on the miner. One would be mounted so as to provide a view of the mining face 22 and the other would be mounted to provide a view in the outbye direction.

To provide the human operator with the "look and feel" of being at the mining face several sensors 174 are provided at or near the mining face 22. A microphone or sound pickup device 178 would be provided so that the human operator can hear what is going on at the mining face 22. An example of other sensors 174 include thermocouple sensors, current transducers, inclinometer, differential pressure transducers, liquid level measures, linear displacement transducers, angle transducers, accelerometers, methanometers, and the above mentioned video cameras 180 and 182. It should be noted that other sensor types are possible and can be incorporated into the design without deviating from the spirit of the invention.

The Coal Haulage System

The coal haulage system in the embodiment depicted in FIG. 1 comprises a chain or belt conveyor 196. This conveyor 196 has one end located at the outbye end of the continuous miner 14 and the other end connected to a powered conveyance 198 in the chain or belt conveyor entry 20. The primary purpose of the conveyor 196 is to provide a variable length conveyor that will move in relation to the mining face 22. Conveyor 196 is self-guided and is turned either on or off by the slave computer 160. The coal that is extracted from face 22 is sent down conveyor 196 and exits the powered conveyance 198 and is then loaded into a cart or another conveyor 200 which removes the coal from the mine.

The Ventilation System

Another necessary function of the mining system is to ventilate the working face area 22 and ventilation system 16 depicted in FIG. 1 is used for this purpose. Even though there will be no mining personnel at the face 22 while the coal is being mined and hauled, the ventilation system 16 is required to remove potentially explosive mixtures of methane gas and fine sized coal dust. A flexible ventilation channel or pipe 190 removes air from the face 22 and blows it to an outbye region 192. This blowing is accomplished by a portable fan 194 which is attached to the ventilation channel 190 in the outbye region 192. The fan 194 and ventilation channel 190 are conventional in nature but do have the ability to move with the continuous miner 14 as it advances along the face 22. A slave computer may control the movement of the ventilation pipe 190 and the turning on and off of the fan 194.

Overall Operation

Considering the overall operation of the remote mining system 10, the continuous miner 14, coal haulage system, and ventilation system are remotely or teleoperated from the base station 12. While coal or other minerals are being extracted underground, no mining personnel are present at the face area 22 of the mining operation. The continuous mining machine 14, ventilation system, and coal haulage system are controlled remotely from the operator control module 12B by a host computer 126 which interprets the desires of the human operator by reading his inputs on a primary and secondary control units 124 and 122 respectively. The human operator would enter his desired actions via the control units 122 and 124 and the computer would then interpret this input and send a signal to the slave computer 160 which is located on the continuous miner 14. The slave computer 160 after receiving the signal would verify that this is a correct signal and then interpret the commands that are encoded in the signal. The slave computer would then control the continuous miner 14, the chain or belt conveyor 196, optionally the fan 194, and/or the cameras 180 and 182. The sensors 174, sound sensor 178, and the cameras 180 and 182 would send their respective signals back to the host computer system 126 via the slave computer system 160 and the communication/control line 18. The host computer would then check the integrity of this information before displaying this information on the video monitor 112 in a custom format. Thus, the human operator has visual and audible feedback of his actions. The computer system serves the function of providing the human operator the "look and feel" of being at the mining face 22 while the actual operator is safely located hundreds of feet away.

Alternative embodiments include incorporating other teleoperated machines for eliminating the need for humans being present while these machines accomplish their tasks. Two examples of future teleoperated machines include roof bolting machines and rock dusting equipment. Another alternative embodiment concerns reducing the human operator's need to closely monitor and control the coal cutting process since the computers have the capability to run the miner 14 automatically. With the proper software, it is possible to have an automated cutting cycle of either an open or closed loop type and even to allow the miner 14 to selectively mine the face 22.

Although the present invention has been described with reference to specific exemplary embodiments thereof, it will be understood by those skilled in the art that variations and modifications can be effected in these exemplary embodiments without departing from the scope and spirit of the invention.

What is claimed is:

1. A teleoperated mining system comprising: a thin seam continuous miner for mining in a thin seam mine which, in use, is located at a mining face of the mine; at least one camera mounted on said continuous miner; a ventilation system for removing combustible material from said mining face; a haulage system for removing material mined by said continuous miner from said mining face to a collection site; a slave computer mounted on said continuous miner for controlling the operation of said continuous miner, said camera, said ventilation system, and said haulage system; a plurality of sensors for relaying information relating to operating conditions of said miner to said slave computer; and a base station connected to said miner by cables/hoses and comprising a cable/hose handling module for winding or unwinding said cables/hoses, a hydraulic power and air compressor module for supplying air to said continuous miner, and an operator control module housing at least one monitor for displaying an image of the mining face produced by said camera, and a host computer for interpreting inputs from an operator, for controlling displaying of said information relating to the operating conditions of said miner on a further monitor, and for controlling said slave computer via a two wire communications line connected at one end thereof to said slave computer and at the other end thereof to said host computer.

2. The system recited in claim 1 wherein said host computer comprises a programmable logic controller, a power supply, a collocated personal computer or clone, and at least one input/output means for receiving input data and controlling output data from said host computer.

3. The system recited in claim 1 wherein said slave computer comprises a power supply, a remote controller for controlling said miner, said ventilation system, said haulage system, and said camera, and at least one input/output means for gathering information from said sensors and controlling said camera.

4. The system recited in claim 1 wherein said operator control module has a compartment with a maximum height of about 32 inches so as to permit said operator control module to be located in a mine.

5. The system recited in claim 4 wherein said operator control module further comprises an adjustable seat for an operator located within said compartment.

6. The system recited in claim 1 wherein said operator control module further comprises a primary control unit for providing input to said host computer, a secondary control unit for providing input to said host computer, and at least one monitor, connected to an inner top surface of said compartment by an adjustable mount, for displaying information from said sensors and cameras.

7. The system recited in claim 1 wherein said operator control module further comprises an adjustable foot rest for an operator.

8. The system recited in claim 1 further comprising a roof bolting machine, controlled by a further slave computer, for securing a roof to the thin seam mine.

9. The system recited in claim 1 further comprising a rock dusting machine, controlled by a further slave computer, for applying rock dust to the freshly mined coal surfaces.

10. A teleoperated mining system comprising: a thin seam continuous miner for mining in a thin seam mine which, in use, is located at a mining face of the mine; at least one camera mounted on said continuous miner; a ventilation system for removing combustible material from said mining face; a haulage system for removing material mined by said continuous miner from said mining face to a collection site; a plurality of sensors for relaying information relating to operating conditions of said miner; a slave computer mounted on said continuous miner for controlling the operation of said continuous miner, said camera, said ventilation system, and said haulage system, said slave computer further comprising a power supply, a remote controller for controlling said miner, ventilation system, haulage system, and camera, and at least one input/output means for gathering information from said sensors and said camera; and a base station connected to said miner by cables/hoses and comprising a cable/hose handling module for winding or unwinding said cables/hoses, and comprising a cable/hose handling module for winding or unwinding said cables/hoses, a hydraulic power and air compressor module for supplying air compressor module for supplying air to said continuous miner, and an operator control module housing at least one monitor for displaying said information from said camera, a host computer for interpreting inputs from an operator, for controlling displaying of said information from said sensors on a further monitor, and for controlling said slave computer via a two wire communications line connected at one end thereof to said slave computer and at one end thereof to said slave computer and at the other end thereof to said host computer, said host computer further comprising a programmable logic controller, a power supply, a collocated personal computer or clone, and at least one input/output means.

11. A teleoperated mining system comprising: a thin seam continuous miner for mining in a thin seam which, in use, is located at a mining face of the mine; at least one camera mounted on said continuous miner; a ventilation system for removing combustible material from said mining face; a haulage system for removing material mined by said continuous miner from said mining face to a collection site; a plurality of sensors for producing information relating to operating conditions of said miner; a roof bolting machine for securing a roof of the thin seam mine; a rock dusting machine for depositing rock dust; a first slave computer mounted on said continuous miner for controlling the operation of said continuous miner, said camera, said ventilation system and said haulage system, a second slave computer mounted on the roof bolting machine for controlling said roof bolting machines, and a third slave computer mounted on the rock dusting machine for controlling said rock dusting machine, said slave computers each comprising a power supply, a remote controller, and at least one input/output means for gathering information from said sensors and said camera; and a base station connected to said miner by cables/hoses and comprising a cable/hose handling module for winding or unwinding said cables/hoses, a hydraulic power and air compressor module for supplying air to said continuous miner, and an operator control module housing at least one monitor for displaying an image of the mining face produced by said camera, a host computer for interpreting inputs from an operator, for controlling displaying of said information relating to the operating conditions of said miner on a further monitor, and for controlling said slave computers via a two wire communications line connected at one end thereof to said slave computers and at the other end thereof to said host computer, said host computer further comprising a programmable logic controller, a power supply, a collocated personal computer or clone, and at lest one input/output means.

* * * * *